US005724942A

United States Patent [19]

Maute et al.

[11] Patent Number: 5,724,942

[45] Date of Patent: Mar. 10, 1998

[54] METHOD AND APPARATUS FOR REGULATING ENGINE TORQUE

[75] Inventors: Kurt Maute, Sindelfingen; Wolfgang Strauss, Denkendorf; Hartmut Weckermann, Stuttgart, all of Germany

[73] Assignee: Mercedes-Benz AG

[21] Appl. No.: 767,253

[22] Filed: Dec. 13, 1996

[30] Foreign Application Priority Data

Dec. 13, 1995 [DE] Germany ..... 195 46 554.7

[51] Int. Cl.[6] ..... F02D 31/00

[52] U.S. Cl. ..... 123/352

[58] Field of Search ..... 123/352, 339.2; 364/431.07, 426.04

[56] References Cited

U.S. PATENT DOCUMENTS

| | | | |
|---|---|---|---|
| 5,224,045 | 6/1993 | Stasell | 364/431.07 |
| 5,270,934 | 12/1993 | Kobayashi | 364/426.04 |
| 5,392,215 | 2/1995 | Morita | 364/426.04 |
| 5,434,786 | 7/1995 | Sakonjyu et al. | 364/426.04 |
| 5,463,993 | 11/1995 | Livshits et al. | 123/339.2 |
| 5,465,208 | 11/1995 | Mochizuki et al. | 123/352 |

FOREIGN PATENT DOCUMENTS

| | | | |
|---|---|---|---|
| 4211173 | 10/1993 | Germany | 123/352 |
| 4342333 | 6/1995 | Germany | 123/352 |

OTHER PUBLICATIONS

Vogel magazine article, Oct. 30, 1996, with English synopsis attached.

*Primary Examiner*—Raymond A. Nelli

*Attorney, Agent, or Firm*—Evenson, McKeown, Edwards & Lenahan, P.L.L.C.

[57] ABSTRACT

The invention provides a method and apparatus for engine torque regulation in which, for rapid engine torque reduction, fuel injection is cut out using a cutout pattern that can be selected from a predetermined set of cutout patterns, as a function of the deviation of the engine torque. According to the invention, an engine-torque-reducing throttle position intervention is also implemented parallel to the fuel injection cutout. The difference in torque between a load-indicated actual engine torque (derived from an engine air volume measurement) and the required set engine torque can be regulated with an appropriate reduction of the degree of injection cutout in stages.

6 Claims, 1 Drawing Sheet

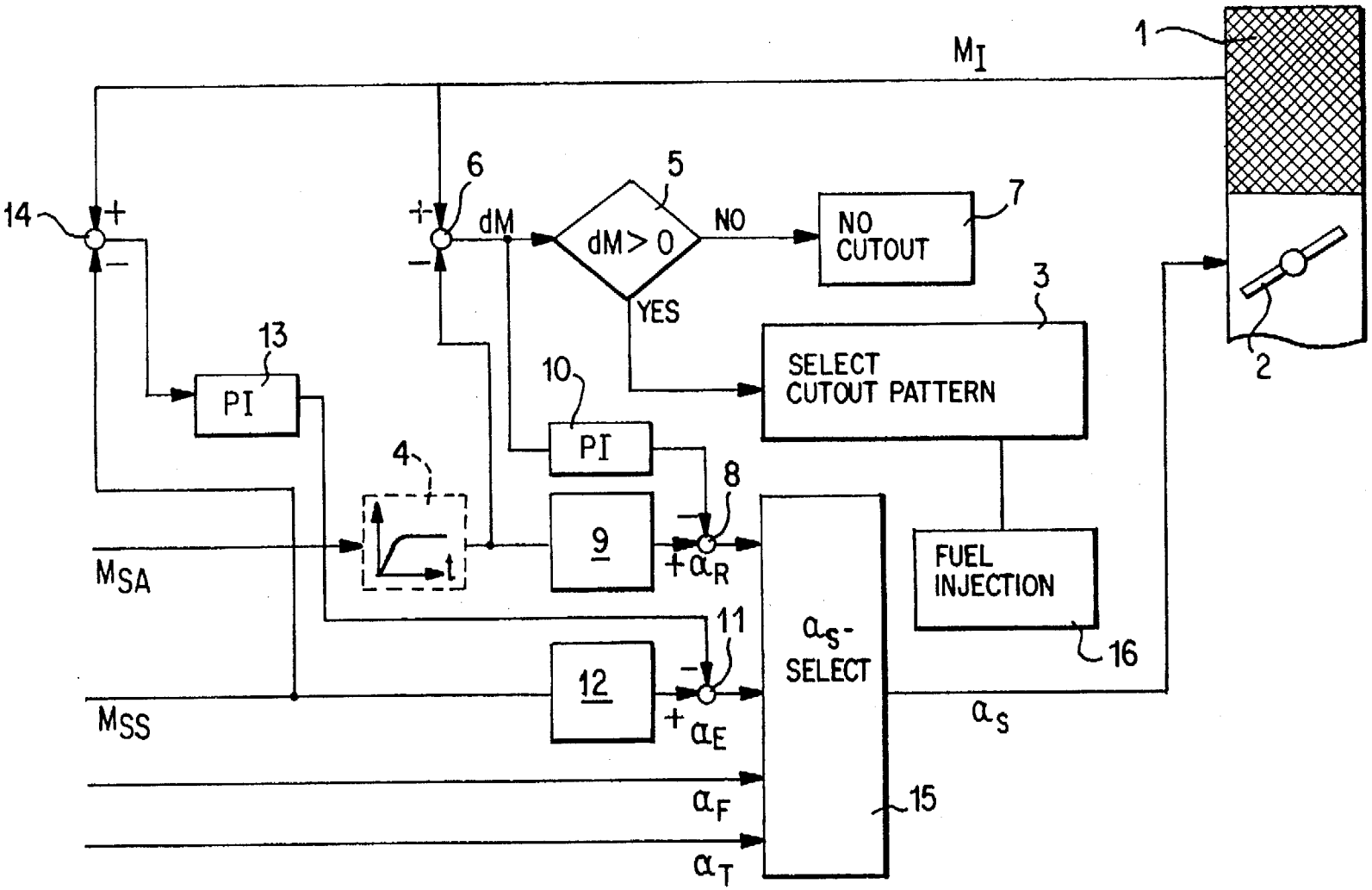
1
2
3
SELECT CUTOUT PATTERN
FUEL INJECTION
16
$M_I$
$\alpha_S$
7
NO CUTOUT
15
$\alpha_S$-SELECT
NO
5
dM > 0
YES
8
$+\alpha_R$
11
$+\alpha_E$
$\alpha_F$
$\alpha_T$
PI
10
9
12
dM
6
4
13
PI
$M_{SA}$
$M_{SS}$
14

METHOD AND APPARATUS FOR REGULATING ENGINE TORQUE

BACKGROUND AND SUMMARY OF THE INVENTION

The invention relates to a method and apparatus for regulating the output torque of an engine suitable.

A method and apparatus of this generic type are disclosed in German patent document DE-OS 42 11 173 A1 as part of a drive slip regulator for a motor vehicle engine with spark ignition. In this drive slip regulator, when excessive drive slip occurs, surplus engine torque is calculated as a function of this drive slip, the transmission ratio, the current engine torque corresponding to the operation of an associated engine control unit, the moment of inertia of the drive train and the wheels. When the current engine torque is reduced by the amount of surplus torque thus calculated, the excessive drive slip disappears. For this purpose, the calculated surplus torque value is fed to an engine torque reduction control that regulates fuel injection on the basis of a cutout pattern (that is, a modification of the fuel injection pattern in which a portion of the normal fuel injection is suppressed, or "cut out", for a particular cylinder or cylinders) selected from a set of predetermined cutout patterns, which is periodic over a certain number of cylinders and a certain number of operating cycles. In this manner, a torque reduction which corresponds to the surplus torque is set by a suitable injection cutout.

In addition to the injection cutout, provision is made in this regulation process for adjusting the original ignition angle so that the drive torque is modified by an adjustment torque that is part of the reduced torque amount and corresponds in value at least to a part of the step range that can be obtained by the injection cutout for the reduced torque. In another control process the altered ignition angle is returned uniformly to the original ignition angle. An additionally provided throttle control operates in conventional fashion as a function of the load, without intervening in control of the drive slip regulator by engine torque reduction, and the reaction time of the throttle angle changes are compensated by temporary changes in the ignition angle.

German patent document DE-OS 43 42 333 A1 discloses another control device for torque reduction by means of a fuel injection cutout, as part of drive slip regulation, in which the cutout patterns and a suitable method for switching between the various cutout patterns are described in detail. Conventionally, the cutout patterns are not stored directly as a function of the instantaneous value of engine torque deviation, but as a function of drive wheel slip.

Drive slip and engine torque regulation methods are also known in which a required reduction of engine drive torque is performed first by adjusting the throttle angle. However, since the reaction to this measure is relatively slow, when rapid reduction is required, a retardation of the ignition timing is also superimposed on the throttle angle adjustment. If these measures still do not suffice, additional fuel injection cutout measures are performed. A system of this kind is described in Jürgen Kasedorf, Service-Fibel für die Steuerungselektronik an Motorkraftübertragungen [Basic Service for Control Electronics for Motor Vehicle Transmissions], Vogel-Verlag, 1989, pages 394 to 396.

The object of the present invention is to provide a device of the type recited at the outset for regulating engine torque, by which required engine torque reductions can be performed with comparatively low expense and short reaction time, as well as favorable engine torque dynamics.

This goal is achieved according to the invention by means of engine torque reductions which are implemented by a parallel combination of fuel injection cutout and engine throttle adjustment. That is, initially a required engine torque reduction is performed primarily by the rapidly reacting injection cutout; thereafter the task is taken over by the engine-torque-reducing effect of throttle intervention, with a simultaneous stepwise reduction of fuel injection cutout. Injection cutout measures are therefore always performed within limits, only during those periods of time in which a required engine torque reduction has not yet been achieved by the reacting throttle control, which is slower to react.

Ignition angle intervention is not provided in this procedure, thus keeping the cost of implementation relatively low. Possible applications are found in all systems with automatic engine torque intervention such as drive slip regulation, engine drag regulation, transmission intervention systems operating with engine torque reduction, and systems for limiting load and/or speed.

In a preferred embodiment of the invention, the individual cutout stages are based on the difference between the actual engine torque (indicated by the load and drive on the basis of an engine air volume measurement) and a desired set engine torque, this difference preferably being based on a percentage of the load-indicated engine torque. The actual engine torque corresponds to the product of the load-indicated engine torque and the number of cylinders that are not cut out.

In another embodiment, the difference between the load-indicated actual engine torque and the set engine torque acts to select the correct fuel injection cutout pattern in parallel to the throttle control in such fashion that the throttle control works to adjust the load-indicated engine torque, performing a throttle adjustment intervention to reduce engine torque, even if the actual engine torque has already been reduced to a desired set engine torque in the meantime by a suitable fuel injection cutout. During the further course of the engine-torque-regulating intervention, the load-indicated actual engine torque approaches the set engine torque, resulting in a gradual reduction of the associated final difference in torque. This in turn causes a decrease in the number of injection cutouts by a transition to a cutout pattern that has fewer and fewer cutouts per cutout period, until the total required torque reduction is finally achieved by the throttle control alone, and no further injection cutout measures are required. The assumption of the engine-torque-reducing effect of the injection cutout by the throttle control operates completely automatically, through feedback of the difference between the load-indicated actual engine torque and the set engine torque.

Other objects, advantages and novel features of the present invention will become apparent from the following detailed description of the invention when considered in conjunction with the accompanying drawings.

BRIEF DESCRIPTION OF THE DRAWING

The Figure of the drawing is a schematic diagram which illustrates he operation of the torque control according to the invention.

DETAILED DESCRIPTION OF THE DRAWING

The engine-torque-regulating device shown in the Figure includes a hot-film air volume measuring element (1) for detecting the engine air volume, which is a measure of the corresponding load-indicated actual engine torque A throttle (2) and conventional fuel-injection members (16) which are controlled in accordance with conventional criteria, on the basis of a stored set of cutout patterns for injection cutout processes, serve as the adjusting elements. The stored set of cutout patterns can consist, for example, of stepped cutout patterns for a four-cylinder engine, in which one or more of eight successive injections is cut out in succession.

In the selection unit (3), an individual cutout pattern is selected, based on the magnitude of the difference (dM) between the detected load-indicated actual engine torque ($M_I$) and the set engine torque ($M_{SA}$) required by a drive slip regulator, the latter being subjected to suitable dynamic adjustment by a filter stage (4) (indicated by a dashed line in the figure). For this purpose, it is determined in block (5) whether the difference between the load-indicated actual engine torque ($M_I$) and the set engine torque ($M_{SA}$) determined by a corresponding subtracter (6) is positive. If not, no engine-torque-reducing is required by the drive slip regulator, and accordingly, no injection cutout is implemented, as shown in block (7). On the other hand, if this final torque difference (dM) is positive, a suitable cutout pattern will be selected by the selection unit (3), based thereon. For this purpose the torque differential (dM) is expressed as a percentage of the load-indicated actual engine torque ($M_I$), and a corresponding percentage range is assigned to each of the cutout patterns. In an injection cutout at the lowest stage, every second injection is cut out at one of the four cylinders, if the percentual torque differential has exceeded a value of 12.5%. With each increase of 12.5%, a transition is made to the cutout pattern of the next higher stage. To switch back from a cutout pattern at a higher stage to the cutout pattern at the next lower stage, an applicable hysteresis threshold is provided to avoid possible oscillation between two adjacent cutout patterns. Of course the respective threshold values to activate a cutout pattern can be varied depending on the individual application.

The fuel shutoff that is triggered along with injection cutout acts on the next higher cylinder in each case. When an increasing degree of torque reduction is required, the starting point for the new cutout pattern is stored in the front half of the pattern; on the other hand, when the reduction requirement decreases, it is stored in the rear half of the pattern, assuming that when the cutout pattern set is stored the injection at a given cylinder is always cut out in the front half of the pattern first. Provision can also be made for suppressing the application of certain cutout patterns within a presettable load-rpm range.

The fuel shutoff is locked as a function of engine temperature, engine rpm, and other influential parameter. As soon as the fuel is shut off from a cylinder, the lambda regulator switches to control operation and a presettable load-offset value is added to the non-linearized load value to correct the residual gas component. In addition, after each fuel shutoff, cylinder-specific fuel enrichment is performed so that a cutout counter detects the successive injection cutouts for each cylinder. A cylinder-specific replacement enrichment factor is determined for each cylinder from a cutout counter value thus obtained as a function of the characteristic, multiplied by an engine temperature value obtained as a function of the characteristic.

A throttle position intervention is performed in parallel with the injection cutout during such an engine torque reduction process. For this purpose a throttle angle setting ($\alpha R$) is determined as a function of time by a conversion unit (9) and a subtracter (8) of a throttle positioning unit, which convert the set engine torque ($M_{SA}$) required by the drive slip regulator into a corresponding throttle angle value. The subtractor (8) also receives the output signal of a PI regulator (10), to which the torque differential (dM) between the load-indicated actual engine torque ($M_I$) and the set engine torque ($M_{SA}$) is applied as an input. (The output signal of PI regulator (10) is limited to an applicable positive or negative maximum value.) PI regulator (10) is active only in operating phases with drive slip regulation.

In this manner, the value of the throttle angle associated with the required set engine torque ($M_{SA}$) has superimposed on it the additional value produced by PI regulator (10), with which the throttle control corrects the difference, uninfluenced by the injection cutout, between the load-indicated engine torque ($M_I$) and the set engine torque ($M_{SA}$), with a simultaneous stepwise reduction of the injection cutout. It should be noted at this point for the sake of clarity that during active injection cutout processes, the actual engine torque differs from the load-indicated engine torque by the factor of the number of cylinders not cut out.

The critical throttle angle set value ($\alpha R$) during the engine-torque-reduction processes that is demanded by the drive slip regulator is fed to a throttle angle selection unit (15) of the throttle setting unit, which also receives a set value ($\alpha F$) detected by the accelerator based on the driver's demand, a set value ($\alpha T$) is based on a cruise control, and a set value ($\alpha E$) based on engine drag regulation for the throttle (2). Based on these inputs the throttle angle selection unit (14) selects the valid throttle angle set value ($\alpha_S$) in accordance with the respective operating conditions.

The throttle set value ($\alpha_E$) is generated in operating phases with active engine drag regulation, by a conversion unit (12) and a subtracter (11) that convert a set engine torque ($M_{SS}$) demanded by the engine drag regulator into a corresponding throttle angle value. Another PI regulator (13) is connected to a subtracter (14) which generates a signal indicative of the torque differential between the last-indicated actual engine torque ($M_I$) and the set engine torque ($M_{SS}$) required in this case by the engine drag regulation. The output signal of PI regulator (13), which is likewise limited to an applicable positive or negative maximum value, is subtracted from the output of conversion unit (12) in the subtractor (11), and the result is then provided as an input to the selection unit (15).

Similarly to the case of drive-slip regulation operating phases described above, with this measure involving corresponding torque differential feedback through the PI regulator (13), even during operating phases with engine drag regulation, a reliable regulation to eliminate the difference between the load-indicated actual engine torque ($M_I$) and the required set engine torque ($M_{SS}$) is performed.

The engine-torque-regulating system according to the invention and shown as an example satisfies a requirement for rapid engine torque reduction in a relatively simple system design by means of a favorable combination of fuel injection cutouts and throttle position intervention, in such fashion that the requirement for rapid torque reduction is met by a corresponding injection cutout and its action during the subsequent process is assumed successively by the more slowly reacting load regulation to the corresponding throttle control, with injection cutouts decreasing automatically. In addition, the cutout pattern is selected as a function of the difference between the load-indicated actual engine torque represented by the engine air volume and the required set engine torque; in other words, by direct torque comparison. At the same time, this difference in torque serves as an input parameter for throttle control, with the latter taking over the torque-reducing function of injection cutouts with its own longer reaction time and the injection cutout simultaneously being reduced stepwise.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Method for regulating engine torque of an engine having a fuel injection system, said method comprising the steps of:

determining an engine torque deviation between a set engine torque and actual engine torque of said engine;

cutting out fuel injection to said engine in accordance with a cutout pattern which is selected from a set of predetermined cutout patterns as a function of said engine torque deviation; and concurrently with said cutting out of fuel injection, implementing an engine torque reducing throttle position control, whereby said actual engine torque is adjusted to said set engine torque.

2. Method according to claim 1, wherein the actual engine torque is determined based on an engine air volume measurement.

3. Method according to claim 2, wherein said engine torque deviation is used as a criterion for selecting the respective cutout pattern.

4. Method according to claim 1, further comprising the steps of:

reducing cutouts of said fuel injection as said engine torque deviation decreases until said engine torque is controlled exclusively by said engine torque reducing throttle control.

5. Apparatus for regulating engine torque of an engine having a throttle valve and a fuel injection system, comprising:

a predetermined set of stored injection cutout patterns;

means for determining an engine torque deviation between a set engine torque and an actual engine torque of said engine;

a fuel injection cutout unit for selecting at least a cutout pattern from among said set of fuel injection cutout patterns as a function of said engine torque deviation;

means for cutting out fuel injection to said engine in accordance with a selected cutout pattern; and a throttle setting unit for setting a throttle angle of said throttle valve, which throttle angle comprises a component determined as a function of said set engine torque and a component which regulates said engine torque deviation.

6. Apparatus for regulating engine torque according to claim 5, wherein said means for cutting out fuel injection reduces cutouts of said fuel injection as said engine torque deviation decreases, until said engine torque is controlled exclusively by said throttle setting unit.

* * * * *